US005766391A

United States Patent [19]

Fletcher

[11] Patent Number: 5,766,391

[45] Date of Patent: Jun. 16, 1998

[54] METHOD FOR MAKING WOVEN POLYPROPYLENE FABRIC WITH FRAYED EDGES

[75] Inventor: Scott Fletcher, Calhoun, Ga.

[73] Assignee: American Weavers, L.L.C.

[21] Appl. No.: 778,910

[22] Filed: Jan. 3, 1997

Related U.S. Application Data

[62] Division of Ser. No. 425,076, Apr. 19, 1995, Pat. No. 5,635,270.

[51] Int. Cl.[6] ..... B32B 31/12; B32B 31/26

[52] U.S. Cl. ..... 156/82; 156/92; 156/93; 156/148; 156/275.1; 139/432

[58] Field of Search ..... 156/82, 91, 92, 156/93, 148, 272.2, 275.1, 275.5, 393; 139/432, 383 R

[56] References Cited

U.S. PATENT DOCUMENTS

| | | | |
|---|---|---|---|
| 4,251,312 | 2/1981 | Ziegler, Jr. et al. | 156/465 |
| 4,421,141 | 12/1983 | Brouwer | 139/54 |
| 4,467,839 | 8/1984 | Westhead | 139/383 A |
| 4,502,513 | 3/1985 | Mueller | 139/383 A |
| 5,167,263 | 12/1992 | Kelen et al. | 139/383 A |
| 5,185,199 | 2/1993 | Sawyer et al. | 428/288 |

FOREIGN PATENT DOCUMENTS

| | | | |
|---|---|---|---|
| 185888 | 11/1982 | Japan | 156/148 |

*Primary Examiner*—David A. Simmons
*Assistant Examiner*—Paul M. Rivard
*Attorney, Agent, or Firm*—Wood, Herron and Evans

[57] ABSTRACT

A woven fabric is formed from polypropylene fibers by simply weaving the fabric using polypropylene fibers in both the warp and weft directions. The edges are left frayed and could become unraveled. In order to prevent the fabric from fraying further, particularly during washing, binding fibers are incorporated at least in the weft direction, but only along the edges. The binding fibers are polyester fibers coated with a low-melting-point thermoplastic adhesive. The thermoplastic adhesive is one that melts at a temperature lower than the melting point of the polypropylene fibers. Once these are incorporated into the fabric at the loom, the fabric is placed in an oven and heated to a temperature above the melting point of the thermoplastic adhesive and below the melting point of the polypropylene fibers to cause the thermoplastic adhesive to melt, binding the polypropylene fibers together. The ends of the fabric can be bonded together by either stitching, by binding fibers incorporated along the weft direction, or by the natural holding characteristics of some yarns such as cotton.

7 Claims, 2 Drawing Sheets

METHOD FOR MAKING WOVEN POLYPROPYLENE FABRIC WITH FRAYED EDGES

This application is a divisional, of application Ser. No. 08/425,076, filed Apr. 19, 1995, now U.S. Pat. No. 5,635,270.

BACKGROUND OF THE INVENTION

There are many different types of fibers which are used to form various fabrics. One such fiber is polypropylene. Polypropylene is inexpensive and can be easily solution dyed. Further, it does not readily stain and thus it is particularly useful in applications such as table cloths, placemats and afghans or throws. One disadvantage of polypropylene fibers is that the fibers themselves have a very low coefficient of friction. Thus, once woven together they do not naturally remain bonded together, particularly if placed in a washing machine.

In weaving, for example, table cloths, placemats and afghans (throws), it is frequently desirable to leave the edge portions unraveled to form a self-fringed fabric. This is usually done for aesthetic purposes. However, due to the inherent nature of polypropylene fibers, they are unsuitable for such applications. When placed in a washing machine, they would unravel.

There are many ways to overcome this problem. The edges can be woven together so that they are not in an unraveled state. Special stitching can be used to bond these unraveled edges together, preventing the fabric from further unraveling, but this is expensive due to additional labor expense. It is also possible to simply melt the edges of the polypropylene together, preventing unraveling. But this is particularly unattractive.

There have been many attempts in the past to incorporate hot-melt adhesive-coated fibers or thermoplastic fibers and use the thermoplastic nature of the fibers to bond woven fibers together. For example, Dickey U.S. Pat. No. 1,854,693 describes securing selvages by melting edge threads using solvent or heat. Scruggs U.S. Pat. No. 2,840,117 employs thermoplastic threads. Further, Westhead U.S. Pat. No. 4,467,839 discloses using thermoplastic weft strands which are melted to fill in gaps in papermaking fabric. Bryant U.S. Pat. No. 4,774,135 discloses coating a glass strand with thermoplastic material to bond woven glass fibers together. Unfortunately, none of these methods would be particularly suitable for use in the present invention.

Typically, glass yarns which incorporate an adhesive are not designed for applications which require a particular aesthetic appearance and are to be used next to skin. Mueller U.S. Pat. No. 4,502,513 discloses weaving the binding fiber along an edge. It is particularly useful for forming straps of material such as safety belts. But, again, this would not be useful in making a placemat, table cloth or afghan (throw).

The solution provided by the Dickey patent is particularly unacceptable. This reference suggests melting the fibers themselves to bond the edges together. This would be very unsightly and particularly unacceptable for polypropylene fabric formed basically from totally polypropylene fibers.

SUMMARY OF THE INVENTION

It is an object of the present invention to provide a method to where polypropylene fibers are woven together leaving an unsewn or unbound edge, but preventing further unraveling of the cloth. Further, it is an object of the present invention to provide a means to bind the edges of the fibers in both the warp or weft direction.

These and other objects of the present invention are achieved by incorporating thermoplastic or hot-melt adhesive-coated fibers along the edge portions of the woven polypropylene fabric. The thermoplastic adhesive is one which melts at a temperature lower than the melting point of the polypropylene. Thus, after being incorporated, the cloth can be heated to a temperature above the melting point of the thermoplastic adhesive and below the melting point of the polypropylene fiber, causing the thermoplastic adhesive to melt, binding the fibers together without having any affect on the polypropylene fibers themselves. By controlling the coating thickness of the thermoplastic adhesive, one can prevent any unsightly bleed-through on the fabric and basically keep the thermoplastic adhesive-coated fibers totally concealed.

The objects and advantages of the present invention will be further appreciated in light of the following detailed descriptions and drawings in which:

DETAILED DESCRIPTION

Figure 1:
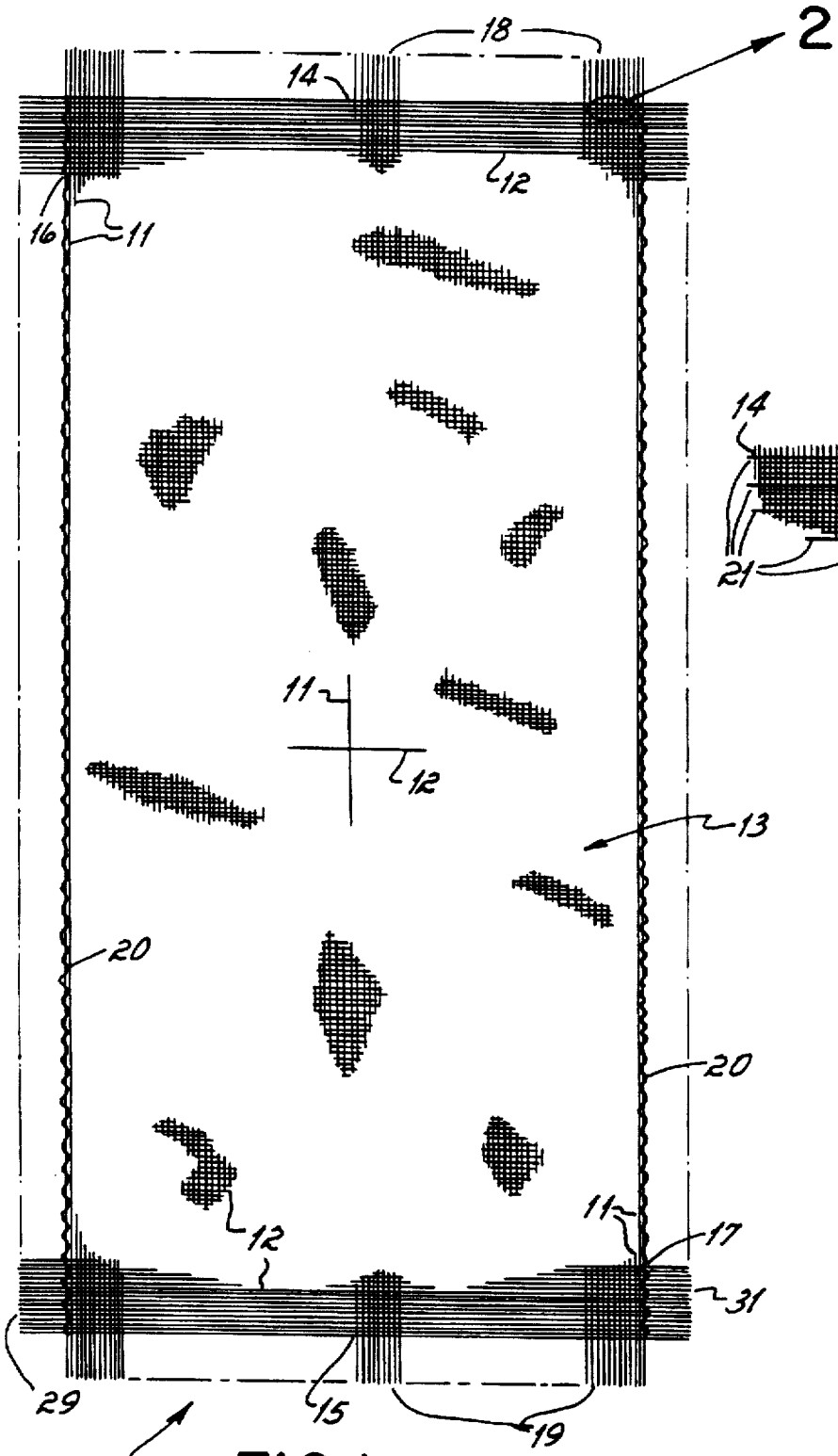
FIG. 1 is a plan view of a cloth made according to the present invention.

According to the present invention, a cloth fabric 10 is formed from polypropylene warp fibers 11 and polypropylene weft fibers 12. The cloth 10 includes a central body portion 13. At the distal ends of the warp fibers are first and second warp ends 14 and 15. At the distal end of the weft fiber are weft ends 16 and 17. The warp ends 14 and 15 include self fringe portion 18 and 19, respectively, and the weft ends 16 and 17 include self fringe portions 29 and 31.

Figure 2:
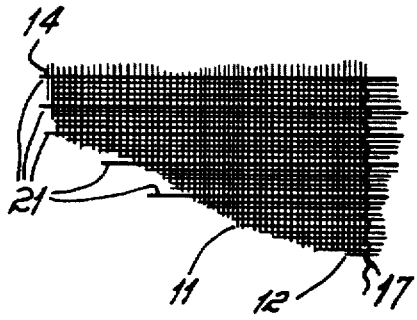
FIG. 2 is an enlarged segment of FIG. 1 taken at circle 2.
Figure 3:
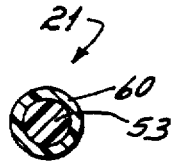
FIG. 3 is a cross-sectional view of a binding fiber used in the present invention.

As best seen with reference to FIG. 2, just interior of the fringe portions 18 and 19 are a combination of the polypropylene warp and weft fibers 11 and 12 and weft binding fibers 21. The binding fibers 21 (FIG. 3) are core fibers 53 coated with a thermoplastic adhesive layer 60. When inserted in the weft direction, this thermoplastic adhesive bonds the polypropylene fibers of the warp direction and the weft direction, as is discussed below. Generally, about 5 to 12 binding fibers 21 will be incorporated along each edge, with 6 to 8 being preferred. The binding fibers are preferably separated from each other for two to three weft fibers.

The warp and weft fibers 11 and 12 along edges 16 and 17 are stitched together by leno thread 20 holding these edges together and preventing the warp fibers 11 from unraveling. Leno threads 20 can be the same thermoplastic adhesive-coated fibers as binding fibers 21.

The fabric can be formed using any typical loom which can be used with a number of different colored yarns woven to provide a particular jacquard or dobby design in the body portion of the fabric. This fabric is particularly suitable for use as a table cloth, placemats or afghans (throws). However, it can be used for a variety of different applications. The stitching thread 20 is incorporated by the loom as the fabric 10 is being woven. The binding fibers 21 are incorporated by the loom into the ends 14 and 15. As shown in FIG. 2, the binding fibers are separated by several polypropylene weft fibers 12.

Once the binding fibers 21 have been incorporated into the fabric during the weaving process, the fabric is heated to melt the thermoplastic adhesive 60, preferably without applying pressure that would cause the thermoplastic adhesive 60 to bleed through the cloth. The thermoplastic adhesive 60, when it solidifies, bonds the binding fibers 21 to polypropylene warp fibers where the two fibers contact each other. This bonding can be accomplished in a number of different manners such as using an application of hot air along the edges, infrared radiation, induction heating, or the like, but is preferably accomplished by simply placing the cloth into an oven for a time effective to heat the adhesive to a temperature which ensures that it melts and bonds to the polypropylene fibers.

The polypropylene fibers for the warp and weft can be selected for their particular aesthetic appearance. Generally, these will be 1000 to 3000 denier fibers and preferably 1200 to 1600, with 1450 denier preferred.

The polypropylene fibers generally have a melting point of about 167° C. (332.6° F.) which is critical for consideration of the present invention. The binding fibers 21 must have an adhesive coating 60 which melts at a temperature significantly lower than 280° F. Preferably, the thermoplastic adhesive will be a low-melting thermoplastic adhesive which has a high-flex modulus such as an elastomeric thermoplastic adhesive. One such adhesive is National Starch brand adhesive which has a ring and ball (softening point) of 225° F. With the National adhesive, a temperature of 240° F. permits the adhesive to adequately flow, but does not cause the polypropylene fibers to melt.

The coating thickness on the binding fibers 21 should range from about 0.0005 inches to about 0.003 inches thick, with a preferred thickness of 0.0015 inches at a viscosity of 5,000 cps at 350° F. This will ensure adequate bonding of the polypropylene fibers without permitting bleed-through marring the edges of the fabric. Of course, the relative thickness should be varied proportionally with the overall thickness of the polypropylene fibers.

The core fiber 53 must have a melting point significantly higher than the melting point of the adhesive, preferably about 100° F. in excess of the melting point of the adhesive. This high melting point is required in order to permit the core fiber to withstand the application temperature of the adhesive, as well as remain stable after the bond takes place. Although the adhesive melts at a relatively low temperature, in the application process, it must be extremely fluid and thus requires higher temperatures.

The core fiber 53 can be a thermoset fiber having a high melting temperature, including a natural fiber such as cotton, but is preferably simply a polyester. In particular, spun polyester filament fibers such as a 2/300/68 spun polyester which has a diameter of 0.020 inches, are preferred. The fiber is best when ring spun, which increases the fuzzy characteristic of the polyester to enhance adhesive pick-up. Polyester is particularly preferable because of its strong, stable characteristics and the fact that it has a 420° F.+ melting point—significantly higher than the 167° C. (332.60° F.) melting point of the polypropylene fabric and the 240° F. melting temperature of the hot-melt adhesive.

Figure 4:
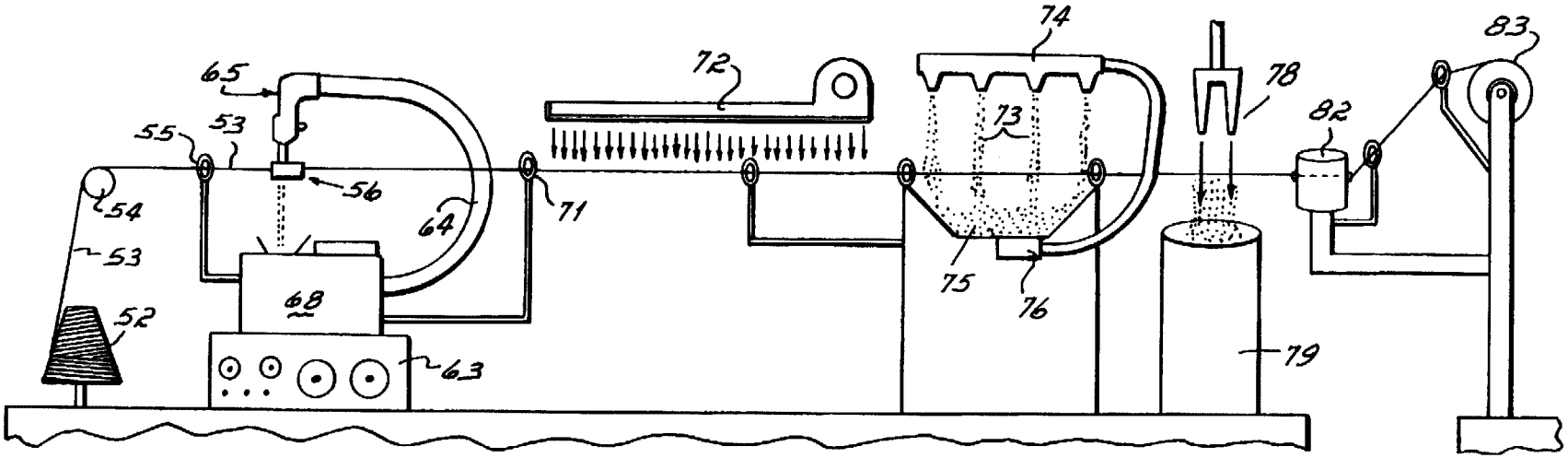
FIG. 4 is a diagrammatic depiction of the apparatus used to produce the thermoplastic adhesive-coated binding fibers of the present invention.
Figure 5:
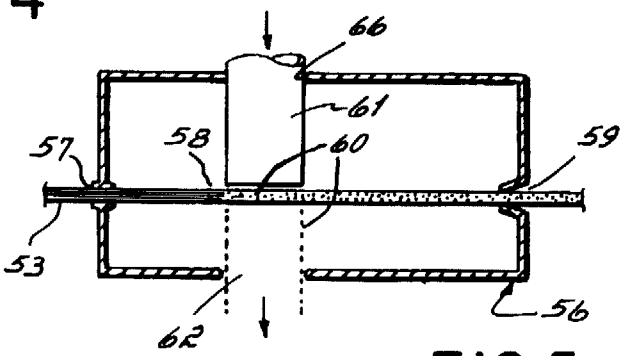
FIG. 5 is a cross-sectional view of the yarn coating chamber used in the present invention.

The binding fibers 21 can be formed by a variety of different methods. FIGS. 4 and 5 show equipment specifically adapted for this process.

This apparatus includes a spool 52 of core yarn fiber 53. This is directed over a tensioning roller 54 through a guide 55 to a application chamber 56. As shown in FIG. 5, the application chamber 56 includes a yarn inlet orifice 57, an internal passage 58 leading to an exit orifice 59. The chamber 56 also includes a central hot-melt passage 61 which intersects with the yarn passage 58. The hot-melt passage 61 includes an outlet orifice 62. As shown, a hot-melt applicator 63 pumps adhesive 60 through a heated conduit 64 to a heated nozzle 65 which directs hot-melt adhesive into an inlet orifice 66 of chamber 56. This passes through the hot-melt passage 61 coating yarn passing through the chamber 56. Excess hot-melt adhesive is forced under pressure down to a heated reservoir 68 of the hot-melt adhesive applicator 63. The yarn is then pulled through a second guide 71 beneath a air blower 72 which directs air onto the yarn 53 passing beneath blower 72 to drive off excess adhesive and expedite solidification of the adhesive.

This then is passed over a lubricant applicator 74 which applies a spray 73 of silicone lubricant onto the yarn 53. Excess silicone is gathered in a reservoir 75 which incorporates a pump 76 which recycles the silicone, sending it back up to the applicator 74. Excess moisture is then removed from the yarn by a high-pressure air jet 78 which forces moisture into a drain 79. The yarn is optionally pulled through a container of talc 82 which applies a final anti-stick agent, permitting the yarn to be wound up in spool 83.

With 2/300/68 polyester yarn, the hot-melt adhesive chamber 56 should have an intake orifice that is 0.03 inches in diameter on the intake side. The hot-melt adhesive is forced onto the yarn under slight pressure to ensure the hot-melt coats and adheres to the yarn as it passes through the orifice. This is accomplished by allowing a continuous flow of adhesive to be pumped through the chamber, exiting through the bottom and back into the heated holding tank. The vertical stream of hot-melt intersects the horizontal flow of yarn, thus forcing penetration. The exit orifice is slightly smaller at about 0.022 inches in diameter, scraping off excess adhesive.

The subsequent cool air applied with blower 72 should effectively cool or cure the coating about 70% with the remaining 30% accomplished by the silicone bath.

A variety of different lubricants could be used, although water-soluble lubricants are preferred since they can subsequently be easily removed. The particular silicone lubricant, Polydimethylsiloxane Emulsion, is purchased from Siltech, Inc. The final compressed air spray is applied at about 150 psi to remove substantially all of the moisture from the yarn.

The talc container 82 is preferably a vibrating bowl of talc to provide a fluidized bed of talc through which the yarn is pulled. As previously indicated, this binding fiber is incorporated along with the weft yarns in areas where sewing or welding would be required to secure the product and prevent unraveling.

The fabric, once formed, is heated in an oven at 260° F. for about 30 seconds, causing the adhesive coating of fibers to melt which secures the yarns together but does not provide any aesthetically unappealing areas. Preferably, the heating is conducted without pressure which would alter the appearance of the fabric. Accordingly, the fabric can be heated with hot air or infrared radiation.

This product is particularly useful for placemats and table cloths, runners, afghans (throws) and the like, but it also can be applied to a variety of different fabrics.

The binding fibers can be incorporated into both the warp and weft directions at any point or location in the fabric, but would generally be incorporated only into the edges. This method can provide cloth which is aesthetically appealing and relatively inexpensive. Both the material cost and the manufacturing process contribute to the low cost of the final product.

This has been a description of the present invention and the preferred method of practicing the present invention. However, the invention itself should be defined only by the appended claims wherein:

I claim:

1. A method of forming cloth from polypropylene fibers leaving unraveled edges comprising weaving polypropylene warp fibers and polypropylene weft fibers to form a body portion of cloth with first and second opposed edge portions unraveled;

weaving into said edge portions binding fibers, said binding fibers having a thermoplastic adhesive coating, said adhesive having a melting point lower than a melting point of said polypropylene fibers;

wherein said polypropylene fibers have a thickness of 1000 to 3000 denier and said thermoplastic adhesive coating is from about 0.0005–0.003 inches;

heating said binding fibers to a temperature at least equal to the melting point of said thermoplastic adhesive, but lower than the melting point of said polypropylene fibers, whereby said adhesive flows, contacting said polypropylene fibers and binding said polypropylene fibers together.

2. The method claimed in claim 1 wherein first and second ends of said cloth are unraveled and wherein said first and second ends are held together by stitching.

3. The method claimed in claim 1 wherein first and second ends of said cloth are unraveled, and wherein said first and second ends are bonded together with binding fibers.

4. The method claimed in claim 1 wherein said binding fibers are heated by placing said cloth in an oven.

5. The method claimed in claim 1 wherein said binding fibers are heated together by infrared radiation.

6. The method claimed in claim 1 wherein said binding fibers are heated by hot air.

7. The method claimed in claim 1 wherein said polypropylene fibers have a thickness of about 1200–2600 denier.

* * * * *